US007368689B2

(12) United States Patent
Roehr et al.

(10) Patent No.: US 7,368,689 B2
(45) Date of Patent: May 6, 2008

(54) DEVICE FOR HEATING BY INDUCTION OF METAL STRIP

(75) Inventors: Philippe Roehr, Lautenbach Zell (FR); Rémy Klein, Soultzmatt (FR)

(73) Assignee: Fives Celes, Lautenbach (FR)

( * ) Notice: Subject to any disclaimer, the term of this patent is extended or adjusted under 35 U.S.C. 154(b) by 0 days.

(21) Appl. No.: 10/548,296

(22) PCT Filed: Mar. 4, 2004

(86) PCT No.: PCT/FR2004/000516

§ 371 (c)(1),
(2), (4) Date: Dec. 19, 2005

(87) PCT Pub. No.: WO2004/082336

PCT Pub. Date: Sep. 23, 2004

(65) Prior Publication Data

US 2006/0151481 A1 Jul. 13, 2006

(30) Foreign Application Priority Data

Mar. 7, 2003 (FR) ..... 03 02892

(51) Int. Cl.
*H05B 6/10* (2006.01)

(52) U.S. Cl. ..... 219/645; 219/646

(58) Field of Classification Search ..... 219/645, 219/646, 635

See application file for complete search history.

(56) References Cited

U.S. PATENT DOCUMENTS 4,778,971 A * 10/1988 Sakimoto et al. ..... 219/645

FOREIGN PATENT DOCUMENTS

| | | |
|---|---|---|
| EP | 0 385 571 A | 9/1990 |
| EP | 0 407 660 A | 1/1991 |
| EP | 0 589 087 A | 3/1994 |
| EP | 1 063 305 A | 12/2000 |

* cited by examiner

*Primary Examiner*—Daniel Robinson
(74) *Attorney, Agent, or Firm*—Connolly Bove Lodge & Hutz LLP

(57) ABSTRACT

The device for heating by electromagnetic induction of a metal strip (A) comprises at least one inductor coil (B) which surrounds an area of the strip in a transversal manner in relation to the longitudinal direction of the strip. The coil (B) comprises at least one monoturn (1) whose median plane (P) is orthogonal in relation to the longitudinal direction (D) of the strip.

10 Claims, 3 Drawing Sheets

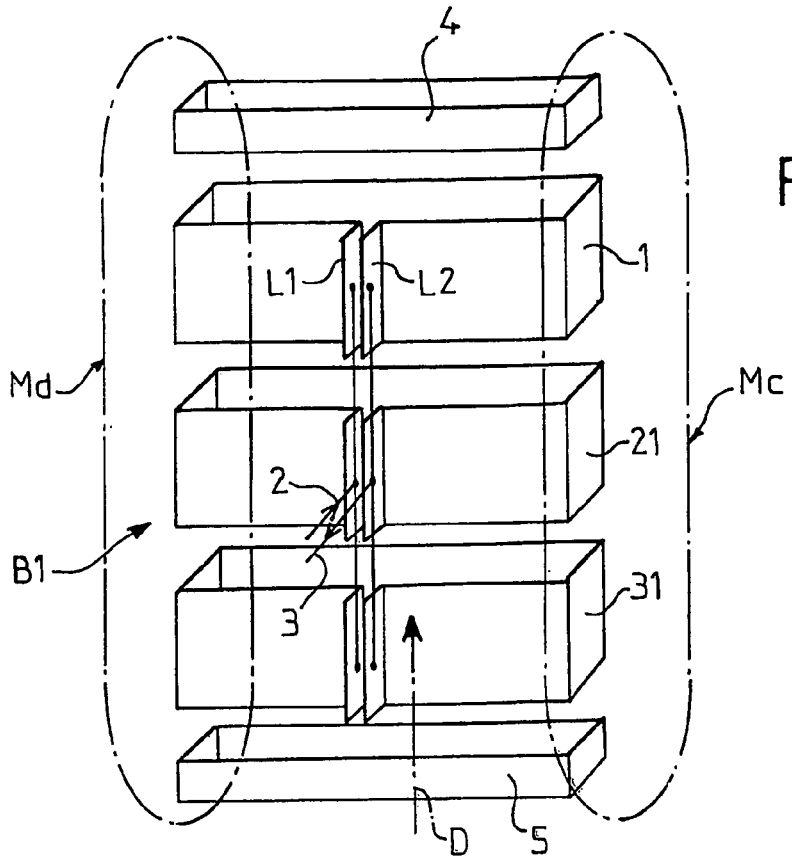
FIG. 7
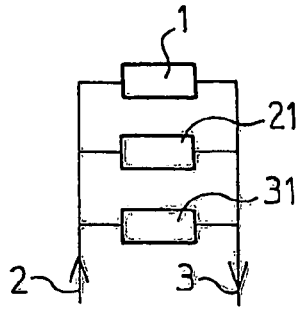
FIG.8
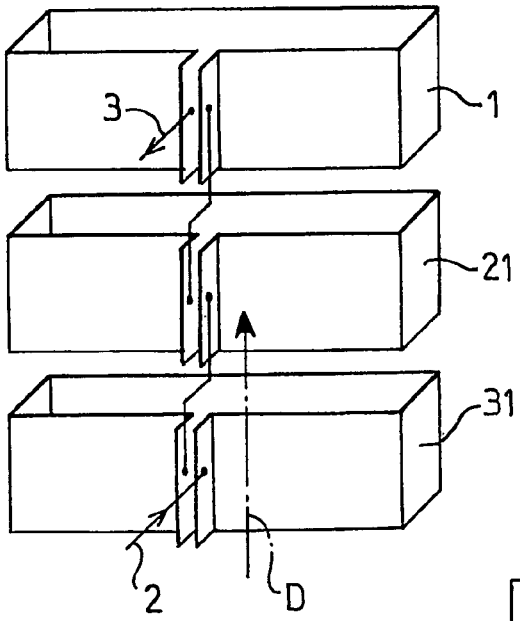
FIG.9
FIG.10
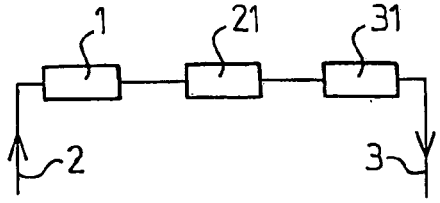

DEVICE FOR HEATING BY INDUCTION OF METAL STRIP

FIELD OF THE INVENTION

The invention relates to a device for heating one or more metal strips by electromagnetic induction, which device comprises at least one induction coil that surrounds a region of the strip(s) transversely to the longitudinal direction of the strip(s).

BACKGROUND OF THE INVENTION

Such a heating device is used for example in metal strip treatment lines, especially for drying a coating, such as a layer of paint, or for heating prior to galvanizing, or heating prior to annealing, applied to this strip, which runs through the induction coil or coils along its longitudinal direction.

BRIEF DESCRIPTION OF THE INVENTION

The object of the invention is most particularly to provide a heating device that makes it possible to reduce or eliminate any defects in the coating on the strip that may appear with the presently known heating devices.

According to the invention, the device for heating a metal strip by electromagnetic induction, comprising at least one induction coil that surrounds a region of the strip transversely to the longitudinal direction of the strip, is characterized in that the coil comprises at least one single turn, the mean plane of which is orthogonal to the longitudinal direction of the strip.

With such an arrangement, the electromagnetic field produced does not have a transverse component in the strip, unlike in the prior art in which the turns of the coil are inclined to the longitudinal direction of the strip. By eliminating this transverse component it is possible to prevent the circulation of parasitic induced currents in the strip, which are the source of potential differences between the strip and the rolls located upstream and downstream of the inductor. These potential differences cause sparks, which affect the coating and the surface finish of the strip. In addition, the transverse temperature uniformity (central edges) are improved compared with a zig-zag inductor.

The coil may comprise several single turns, the mean planes of which are orthogonal to the longitudinal direction of the strip. The single turns may be connected together in series, or in parallel, or in series-parallel.

Each single turn may have two long sides in relation to the width of the strip and two short sides in relation to the thickness of the strip. The current leads may be made on a long side or on a short side.

Preferably, the length of the long sides of the single turn is greater than the width of the strip by an amount such that an accentuated strip edge heating effect is avoided.

The distance between the long sides of the single turn may increase toward the ends of the long sides in such a way that the accentuated strip edge heating effect is avoided. The single turn may have, toward the ends of its long sides, a trapezoidal profile, the long base of which forms a short external side. As a variant, the single turn may have, toward the ends of its long sides, an approximately circular outwardly convex profile.

Advantageously, the heating device includes, at each longitudinal end of the single-turn induction coil, a short-circuiting single turn closed on itself, the mean plane of which is orthogonal to the longitudinal direction of the strip.

The device may include an electromagnetic shield so as to contain the magnetic field essentially along a direction orthogonal to the plane of the strip.

The device may include a field deflector for correcting the edge temperature relative to the central region of the strip.

The invention consists, apart from the abovementioned provisions, of a number of other provisions, which will be explained in further detail below with regard to embodiment examples described with reference to the appended drawings, although these examples are in no way limiting. In these drawings:

BRIEF DESCRIPTION OF THE FIGURES

FIG. 7 is a perspective diagram of a coil comprising three single turns connected in parallel with a short-circuiting turn at each longitudinal end;

FIG. 8 is the circuit diagram of the parallel connection of the single turns of FIG. 7;

FIG. 9 is a perspective diagram of a coil made up of three single turns connected in series;

FIG. 10 is the circuit diagram of the connection of FIG. 9;

DETAILED DESCRIPTION OF THE INVENTION

Figure 1:
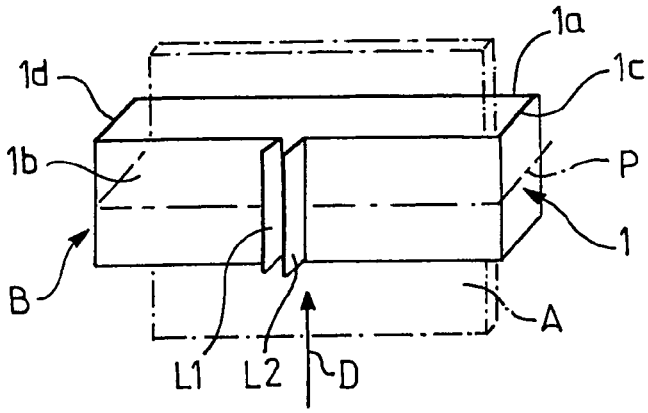
FIG. 1 is a schematic perspective view of a single-turn heating device according to the invention, through which a metal strip passes.

FIG. 1 shows a device for heating a steel strip A, or more generally a metal strip, by electromagnetic induction. In the example of FIG. 1, the strip A runs vertically along its vertical longitudinal direction D shown by an arrow. The heating device comprises at least one induction coil B that surrounds one region of the strip A transversely to the longitudinal direction D.

According to the invention, the coil B comprises at least one single turn 1, the mean plane P of which is orthogonal to the longitudinal direction D of the strip A.

According to FIG. 1, the single turn 1 is formed by a flat conductor having a rectangular profile, the long sides 1*a*, 1*b* of which are parallel to the large faces of the strip and the short sides 1*c*, 1*d* of which are parallel to the edges of the strip.

In FIG. 1, the current leads are made on a long side 1*b*. This long side 1*b* is open substantially at mid-length and has two tabs L1, L2 folded at right angles to the outside relative to the plane of the side 1*b* in order to allow connection to the power supply.

Because of the arrangement of the mean plane P orthogonal to the direction D, the induction coil B produces no parasitic current in the strip A, unlike in the conventional multiturn coils which are not orthogonal to the direction D.

According to the invention, the temperature uniformity over the width of the strip is improved.

Figure 2:
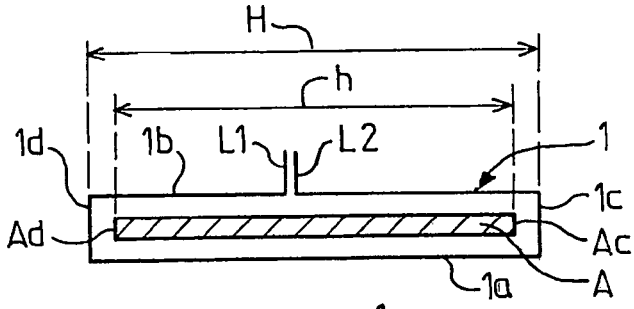
FIG. 2 is a vertical schematic section through a single turn, with the metal strip on the inside.

FIG. 2 shows an arrangement similar to FIG. 1, with a strip A running horizontally, instead of vertically as in FIG. 1.

Figure 3:
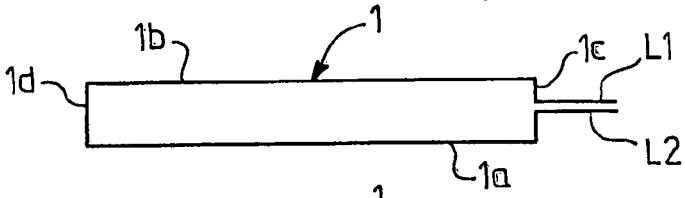
FIG. 3 shows an alternative embodiment of a single turn, the strip not being shown.

FIG. 3 illustrates an alternative embodiment in which the current leads and the tabs L1, L2 are provided in the central region of a short side, for example 1*c*. In FIG. 3, the metal strip A has not been shown.

Figure 4:
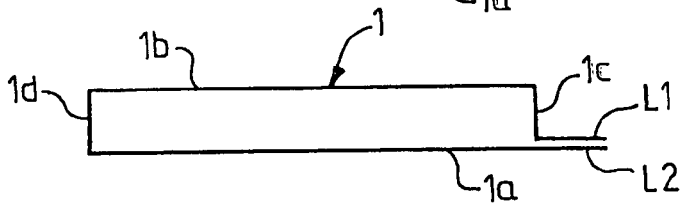
FIG. 4 shows another alternative embodiment of a single turn, similar to that in FIG. 3.

FIG. 4 shows an embodiment of the single turn in which the current leads are formed by tabs L1, L2 provided on one of the ends of a short side, for example 1*c*.

Although the drawings illustrate a single turn made from a flat conductor, it is clear that other types of conductor, for example one with a circular or rectangular cross section, or a combination of several conductors of circular or rectangular cross section, may serve to produce the single turn.

The length H (FIG. 2) of the long sides of the single turn 1 is greater than the width h of the strip by an amount such that an accentuated strip edge heating effect, that is to say an edge heating effect along the edges Ac, Ad, is avoided. As an indication, H may be about 25% greater than h, with an equal distribution in the difference in dimensions on either side of the longitudinal axis of the strip A.

Figure 5:
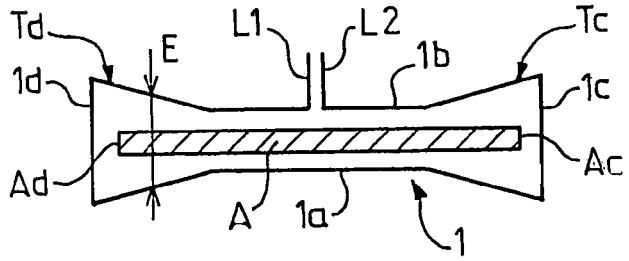
FIGS. 5 and 6 show, in vertical section, two embodiments of a single turn surrounding a strip that runs horizontally.

FIG. 5 illustrates an alternative embodiment in which the distance E between the long sides of the single turn increases toward the ends of these long sides in such a way that the accentuated heating effect along the edges Ac, Ad of the strip is even better avoided.

In FIG. 5, the single turn 1 has, toward the ends of its long sides, a trapezoidal profile Td, Tc, the long base of which forms the short external side 1*c*, 1*d*, whereas the short base of the trapezoid corresponds to the distance between the long sides of the single turn in the central region.

Figure 6:
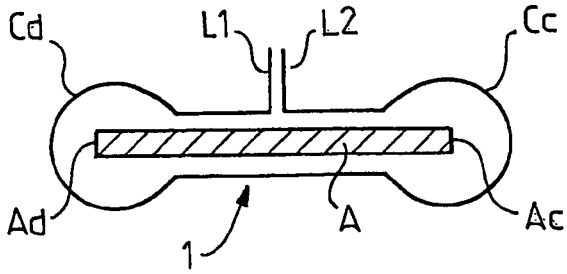

According to the embodiment shown in FIG. 6, the ends of the long sides of the single turn have an approximately circular outwardly convex profile Cd, Cc, which again is favorable to limiting or eliminating the accentuated heating effect along the edges Ac, Ad.

FIG. 7 shows schematically, in perspective, a coil B1 comprising three identical single turns 1, 21 and 31 which are coaxial and connected in parallel as shown in the circuit diagram of FIG. 8. Each single turn 1, 21, 31 has its mean plane orthogonal to the longitudinal direction of the metal strip (not shown in FIG. 7) that runs to the inside of the turns. The device is supplied with AC, generally high-frequency, current via conductors connected in parallel to the lead tabs L1, L2 for each single turn.

Advantageously, a short-circuiting single turn 4, 5, closed on itself, is provided at each longitudinal end of the coil B1, the mean plane of which single turn is orthogonal to the longitudinal direction of the strip. These short-circuiting single turns 4, 5 make it possible to close the electromagnetic field lines, two of which are shown schematically as Mc and Md, shortly after they emerge from the turns 4 and 5. Thus, the electromagnetic field is prevented from propagating further along the longitudinal direction of the strip, so that any interference created by this field on electrical appliances downstream or upstream of the coil B1 is avoided.

FIG. 9 illustrates a coil B2 comprising three coaxial single turns 1, 21, 31 connected in series, as illustrated by the circuit diagram of FIG. 10. The mean plane of each single turn is orthogonal to the longitudinal direction D of the metal strip, which is not shown in FIG. 9.

Of course, the number of single turns connected in parallel or in series may differ from three, for example there may be two single turns or more than three single turns.

Figure 11:
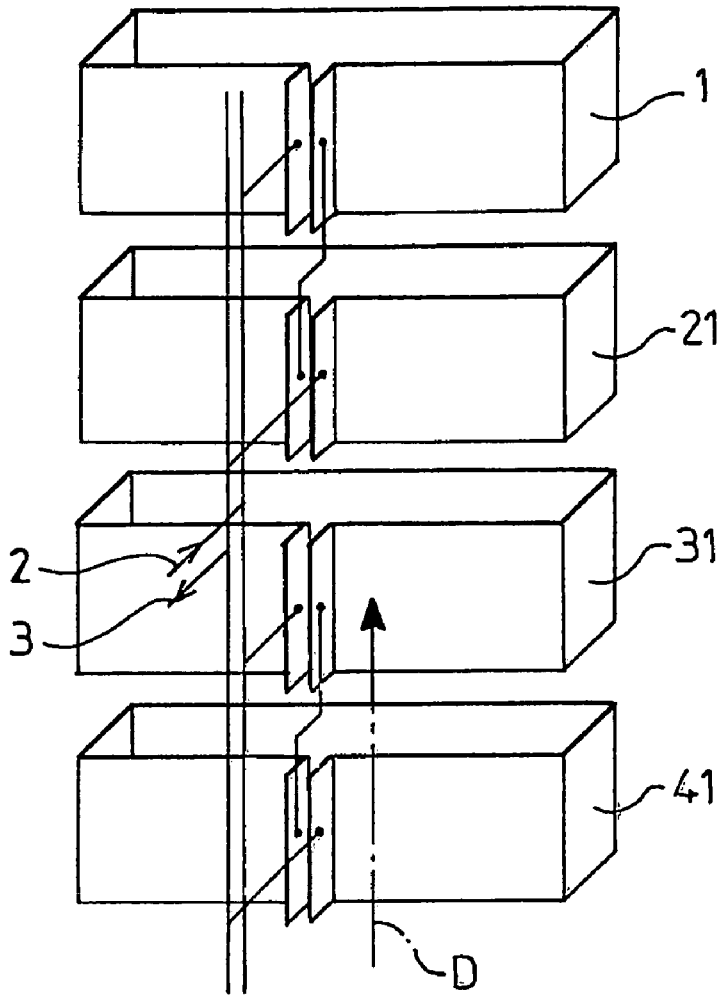
FIG. 11 is a perspective diagram of four single turns connected, pairwise, in series-parallel; and, finally.

FIG. 11 shows schematically, in perspective, a series-parallel arrangement of four coaxial single turns, 1, 21, 31, 41, the mean plane of which is orthogonal to the longitudinal direction D of the steel strip (not shown).

The single turns 1, 21 are connected in series, as are the single turns 31, 41. These two series groups are connected in parallel, as shown schematically by FIG. 12.

Figure 12:
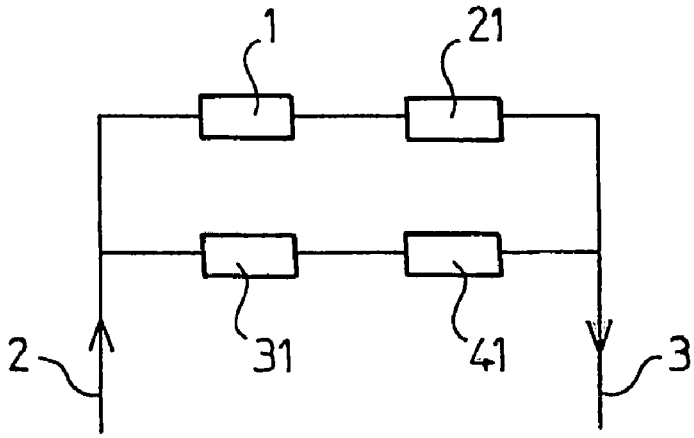
FIG. 12 is the circuit diagram of the connection of FIG. 11.

Of course, the series-parallel connection may be accomplished with a number of single turns that differs from that illustrated in FIGS. 11 and 12.

In all the embodiments shown, it is possible to provide short-circuiting single turns placed at each end of the coil, as in the case shown in FIG. 7.

It is also possible to provide an electromagnetic shield, for example using a magnetic circuit based on metal sheets or ferrites, or a shield produced from copper sheet, so as to contain the magnetic field essentially along a direction orthogonal to the plane of the strip.

The heating device can operate in a controlled or uncontrolled atmosphere.

Field deflectors may be provided, especially for correcting the temperature along the edges Ac, Ad, relative to the central region of the strip.

It will also be possible to provide single turns that are concave along the longitudinal direction of the strip.

The invention claimed is:

1. A device for heating a metal strip by electromagnetic induction, comprising at least one induction coil that transversely surrounds a region of the strip and extends along the longitudinal direction of the strip, wherein the coil comprises at least one single turn, the mean plane of which is orthogonal to the longitudinal direction of the strip, wherein the coil comprises several spaced single turns, the mean planes of which are orthogonal to the longitudinal direction of the strip, the single turns being selectively connected together in series, or in parallel, or in series-parallel.

2. A device for heating a metal strip by electromagnetic induction, comprising at least one induction coil that transversely surrounds a region of the strip and extends along the longitudinal direction of the strip, wherein the coil comprises at least one single turn, the mean plane of which is orthogonal to the longitudinal direction of the strip, in which each single turn has two long sides in relation to the width of the strip and two short sides in relation to the thickness of the strip, and current leads connected on a long side.

3. A device for heating a metal strip by electromagnetic induction, comprising at least one induction coil that transversely surrounds a region of the strip and extends along the longitudinal direction of the strip, wherein the coil comprises at least one single turn, the mean plane of which is orthogonal to the longitudinal direction of the strip, in which each single turn has two long sides in relation to the width of the strip and two short sides in relation to the thickness of the strip, wherein the current leads are connected on a short side.

4. The device as claimed in claim 2, wherein the length of the long sides of the single turn is greater than the width of the strip by an amount such that an accentuated strip edge heating effect is avoided.

5. The device as claimed in claim 2, wherein the distance between the long sides of the single turn increases toward the ends of the long sides in such a way that the accentuated strip edge heating effect is avoided.

6. The device as claimed in claim 5, wherein the single turn has, toward the ends of its long sides, a trapezoidal profile, the long base of which forms a short external side.

7. The device as claimed in claim 5, wherein the single turn has, toward the ends of its long sides, an approximately circular outwardly convex profile.

8. A device for heating a metal strip by electromagnetic induction, comprising at least one induction coil that transversely surrounds a region of the strip and extends along the longitudinal direction of the strip, wherein the coil comprises at least one single turn, the mean plane of which is orthogonal to the longitudinal direction of the strip, wherein it includes, at each longitudinal end of the induction coil, a short circuiting single turn closed on itself, the mean plane of which is orthogonal to the longitudinal direction of the strip.

9. A device for heating a metal strip by electromagnetic induction, comprising at least one induction coil that transversely surrounds a region of the strip and extends along the longitudinal direction of the strip, wherein the coil comprises at least one single turn, the mean plane of which is orthogonal to the longitudinal direction of the strip, further comprising an electromagnetic shield so as to contain the magnetic field essentially along a direction orthogonal to the plane of the strip.

10. A device for heating a metal strip by electromagnetic induction, comprising at least one induction coil that transversely surrounds a region of the strip and extends along the longitudinal direction of the strip, wherein the coil comprises at least one single turn, the mean plane of which is orthogonal to the longitudinal direction of the strip, further comprising at least one field deflector for correcting the edge temperature relative to the central region of the strip.

* * * * *